US006109714A

United States Patent [19]

Tsuruoka

[11] Patent Number: 6,109,714

[45] **Date of Patent: *Aug. 29, 2000**

[54] INK-JET PRINTING APPARATUS WITH A SYSTEM FOR DETECTING REMAINING AMOUNT OF INK

[75] Inventor: Yuji Tsuruoka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,859

[22] Filed: Jun. 3, 1997

[30] Foreign Application Priority Data

Jun. 3, 1996 [JP] Japan ..... 8-140080
Jun. 2, 1997 [JP] Japan ..... 9-144227

[51] Int. Cl.[7] ..... B41J 2/195
[52] U.S. Cl. ..... 347/7
[58] Field of Search ..... 347/7, 14, 19, 347/17

[56] References Cited

U.S. PATENT DOCUMENTS 4,513,314 4/1985 St. John et al. ..... 347/7
5,255,021 10/1993 Noguchi et al. ..... 347/19

*Primary Examiner*—John E. Barlow, Jr.
*Assistant Examiner*—Charles W. Stewart, Jr.
*Attorney, Agent, or Firm*—Fitzpatrick, Cella, Harper & Scinto

[57] ABSTRACT

In order to perform detection of remaining amount of an ink in an ink tank used in an ink-jet printing apparatus, a current to be supplied to an ejection heater for driving the ejection heater to perform ink ejection via a stabilized power source 3 is detected by an FC timer. The FC timer is constructed to cause variation of position of an electrolyte in a mercury depending upon integrated amount of the detected current. Thus, by visually observing the position of the electrolyte in the FC timer, the total consumed amount of the ink can be detected.

19 Claims, 8 Drawing Sheets

INK-JET PRINTING APPARATUS WITH A SYSTEM FOR DETECTING REMAINING AMOUNT OF INK

BACKGROUND OF THE INVENTION

FIELD OF THE INVENTION

The present invention relates generally to an ink-jet printing apparatus. More specifically, the invention relates to detection of remaining amount of ink in an ink tank.

DESCRIPTION OF THE RELATED ART

As an ink tank to be employed in an ink-jet printing apparatus, there are mainly two kinds of ink tanks, one of which is the type directly storing an ink within a tank and the other of which is the type having an ink holding member made of a porous member such as a sponge or the like, which is filled in the tank and soaks the ink. The ink tank of the type directly storing the ink may permit to visually check remaining amount of ink by forming the ink tank per se with a transparent material. It is also possible to easily realize detection system for detecting the remaining amount of ink by utilizing an optical sensor.

On the other hand, in the type of the ink tank, where the ink is soaked in the sponge or the like, a difficulty is often caused to check the remaining amount of ink visually or by means of an optical means, even when the ink tank is formed of the transparent material. Conventionally, it is typical to insert electrodes in the sponge to detect the remaining amount of ink based on variation of resistance value between the electrodes depending upon presence or absence of the ink. However, in this method, a difficulty is encountered in accurately measuring the remaining amount of ink for fluctuation of the resistance value to be detected due to distribution of the ink in the sponge and to fluctuation of the resistance due to tolerance in the ink tank per se.

As one of remaining amount detecting systems capable of solving problems set forth above, there is a method of preliminarily measuring amount of printing to be performed with amount of ink filled with the tank, and of calculating remaining number of dots to be printed to estimate the remaining amount of ink. Calculating of the remaining number of dots is performed by measuring amount of actually effected printing by way of counting number of ink dots actually ejected, and more specifically by way of counting number of data indicative of ink ejection, and by deriving a difference between the preliminarily measured amount and the actually ejected amount. According to this method, precision in detection of the remaining amount of ink can be improved.

However, in order to practice such method, means for counting data indicative of actual ejection of the ink among driving data for driving the printing head and means for integrating the counted value and comparing the integrated value with possible dot number to be printed with the ink filled in the ink tank become necessary. This makes hardware and software relatively complicate.

SUMMARY OF THE INVENTION

Therefore, it is an object of the present invention to provide an ink-jet printing apparatus which derives an ink amount consumed in printing by integrating a supply amount of a drive current to be supplied to an ejection heater for ejecting an ink, whereby realizes accuracy of detection of the ink remaining amount of ink comparable with detection of remaining amount of ink by integration of number of dots, with relatively simple construction and thus at low cost.

Another object of the present invention is to provide an ink-jet printing apparatus which detects electric current supplied to an energy generating element upon ink ejection and integrates the electric current amount per ink ejection to display depending upon the integrated amount to know total ink consumed amount.

In a first aspect of the present invention, there is provided an ink-jet printing apparatus for performing printing by ejecting an ink toward a printing medium with employing an ink-jet head having an energy generating element for generating energy used for ink ejection and performing ink ejection, comprising:

detecting means for detecting a current supplied to the energy generating element upon ink ejection in said ink-jet head;

integrating means for integrating amount of current detected by said detecting means; and display means for performing display depending upon the amount of current integrated by said integrating means.

In a second aspect of the present invention, there is provided an ink-jet head having an energy generating element for generating energy used for ink ejection and performing ink ejection, comprising:

integrating means for integrating amount of current supplied to said energy generating element upon ink ejection by said ink-jet head; and display means for performing display depending upon the amount of current integrated by said integrating means.

In a third aspect of the present invention, there is provided an ink tank for storing an ink to be supplied to an ink-jet head having an energy generating element for generating energy used for ink ejection and performing ink ejection, comprising:

integrating means for integrating amount of current supplied to said energy generating element upon ink ejection by said ink-jet head; and display means for performing display depending upon the amount of current integrated by said integrating means.

In a fourth aspect of the present invention, there is provided an ink-jet unit integrally having an ink-jet head having an energy generating element for generating an energy used for ink ejection and performing ink ejection and an ink tank storing an ink to be supplied to said ink-jet head, comprising:

integrating means for integrating amount of current supplied to said energy generating element upon ink ejection by said ink-jet head; and display means for performing display depending upon the amount of current integrated by said integrating means.

The above and other objects, effects, features and advantages of the present invention will become more apparent from the following description of embodiments thereof taken in conjunction with the accompanying drawings.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings.

DESCRIPTION OF THE PREFERRED EMBODIMENTS

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 1:
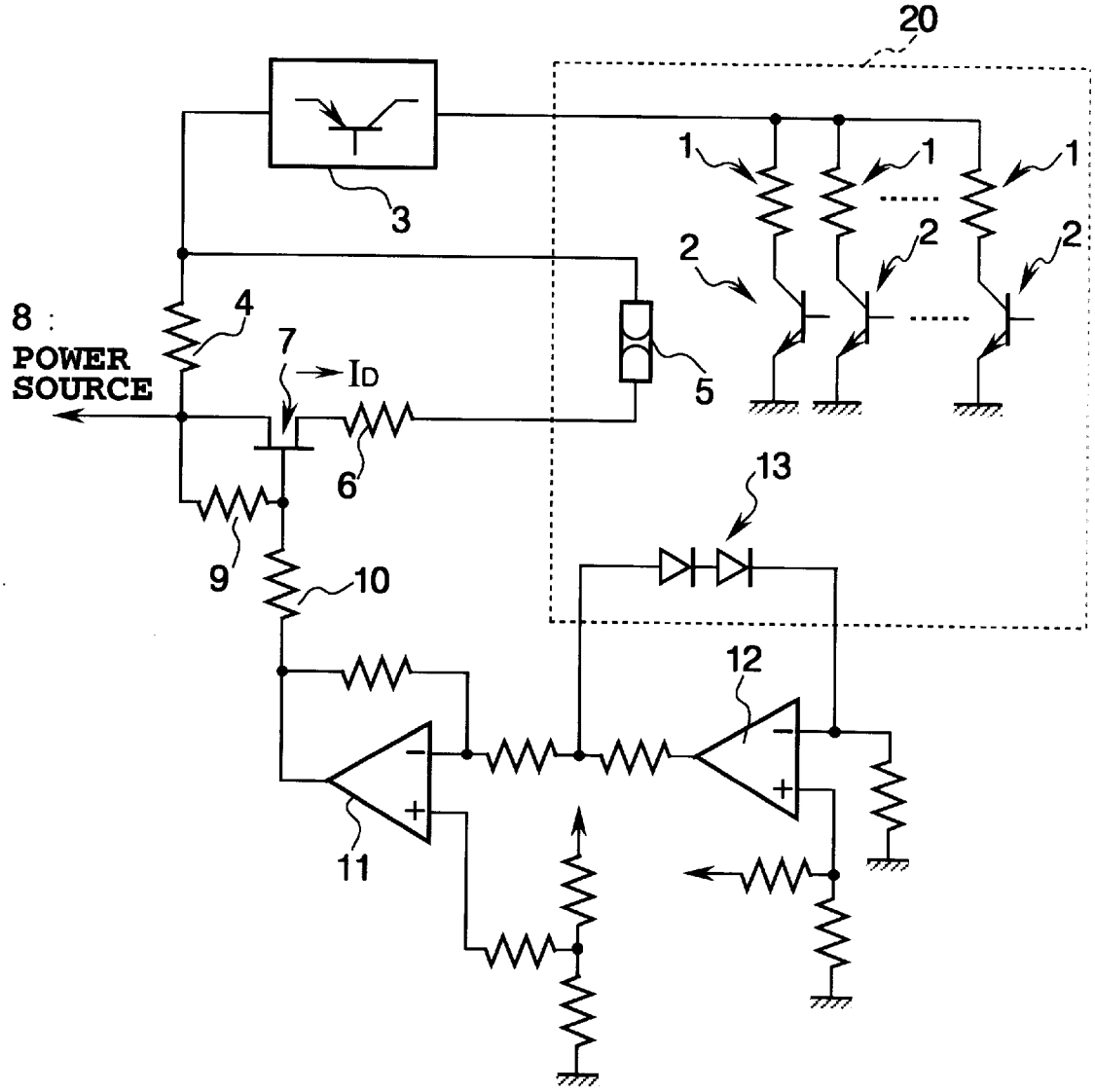
FIG. 1 is a circuit diagram showing one embodiment of a measuring circuit of measuring head drive current and used for detecting remaining amount of ink according to the present invention.

FIG. 1 is a circuit diagram showing one embodiment of a measuring circuit for measuring a head drive current and used for detecting remaining amount of an ink according to the present invention. In FIG. 1, a portion surrounded by broken line represents a circuit portion constructed within an ink-jet head 20, and remaining portion is a circuit portion constructed within an ink-jet printing apparatus. Upon loading and unloading of the ink-jet head in the ink-jet printing apparatus, the respective circuits are mutually connected and disconnected via electrical connecting portions (not shown) having connectors. In the ink-jet head, an ejection heater 1 for generating a thermal energy to be used for ink ejection is provided per each ink ejection opening. In the shown embodiment, the ink-jet head and an ink tank are integrated with each other.

For the ejection heater 1 of the ink-jet head 20, an electric current is caused by actuation of a driver 2 as a switching element connected thereto. The ejection heater 1 thus generates a thermal energy to generate a bubble in an ink and whereby to eject the ink by a pressure of the bubble. At this ejection operation, an ejection data indicative of whether the ejection heater 1 is to be driven or not is feed from a main body of the printing apparatus to the ink-jet head and stored in a latch (not shown) in a head driver circuit. Based on the latched data, switching of the driver 2 is performed. Between a pair of terminals of the ejection heater 1, a terminal other than a terminal to be connected to the driver 2, is connected to an output terminal of a stabilized power source circuit 3. In an electrical connection structure of the ejection heater as set forth above, a drive current flowing through the ejection heater 1 can be detected by measuring an output current of the stabilized power source circuit 3.

Figure 2:
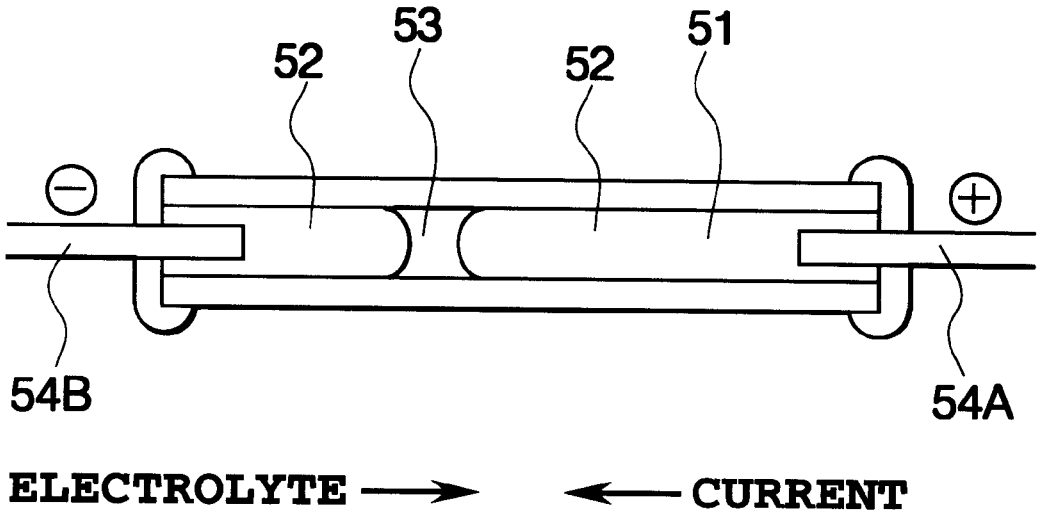
FIG. 2 is an illustration showing an FC timer structure to be employed in the measuring circuit of FIG. 1.

On the other hand, when an ink temperature is constant, ejection amount of ink depends on driving energy supplied to the ejection heater 1. Therefore, by integrating the driving energy, the ejection amount of ink can be detected. In the shown embodiment, a voltage to be applied to the ejection heater 1 is determined by the stabilized power source circuit 3, and then is constant. Therefore, the ink consuming amount is detected by integrating a driving current. A correction method at occurrence of fluctuation of the ink temperature will be explained later. An FC timer 5 (available from Fuji Ceramics K.K.) forms integration means of the driving current. As shown in FIG. 2, the FC timer 5 is constructed by enclosing an electrolyte 53 and mercury 52 within a glass tube 51. A position of the electrolyte 53 of the FC timer 5 is variable depending upon amount of a total current flown between electrodes 54A and 54B. Accordingly, the amount of supplied power can be indicated by the shifting magnitude of the electrolyte 53. Generally, an FC timer is known as an electrolyte type integrating meter, and is used as a timer for integrating a current to show time.

In the circuit shown in FIG. 1, the FC timer 5 is inserted at an input side of the stabilized power source circuit 3 instead of the output side. Most current loss in the stabilized power source circuit 3 is a base current of a transistor in the stabilized power source circuit, which is ignobly small in comparison with an output current. Therefore, even when current is monitored by inserting the FC timer 5 at the input side of the stabilized power source circuit 3, no significant problem will be arisen in measurement of the total current amount. Further, an appropriate amount of the current flowing through the FC timer 5 is generally several tens $\mu$A. Thus, by dividing the current by resistors 4 and 6, a current value is adjusted.

Figure 3:
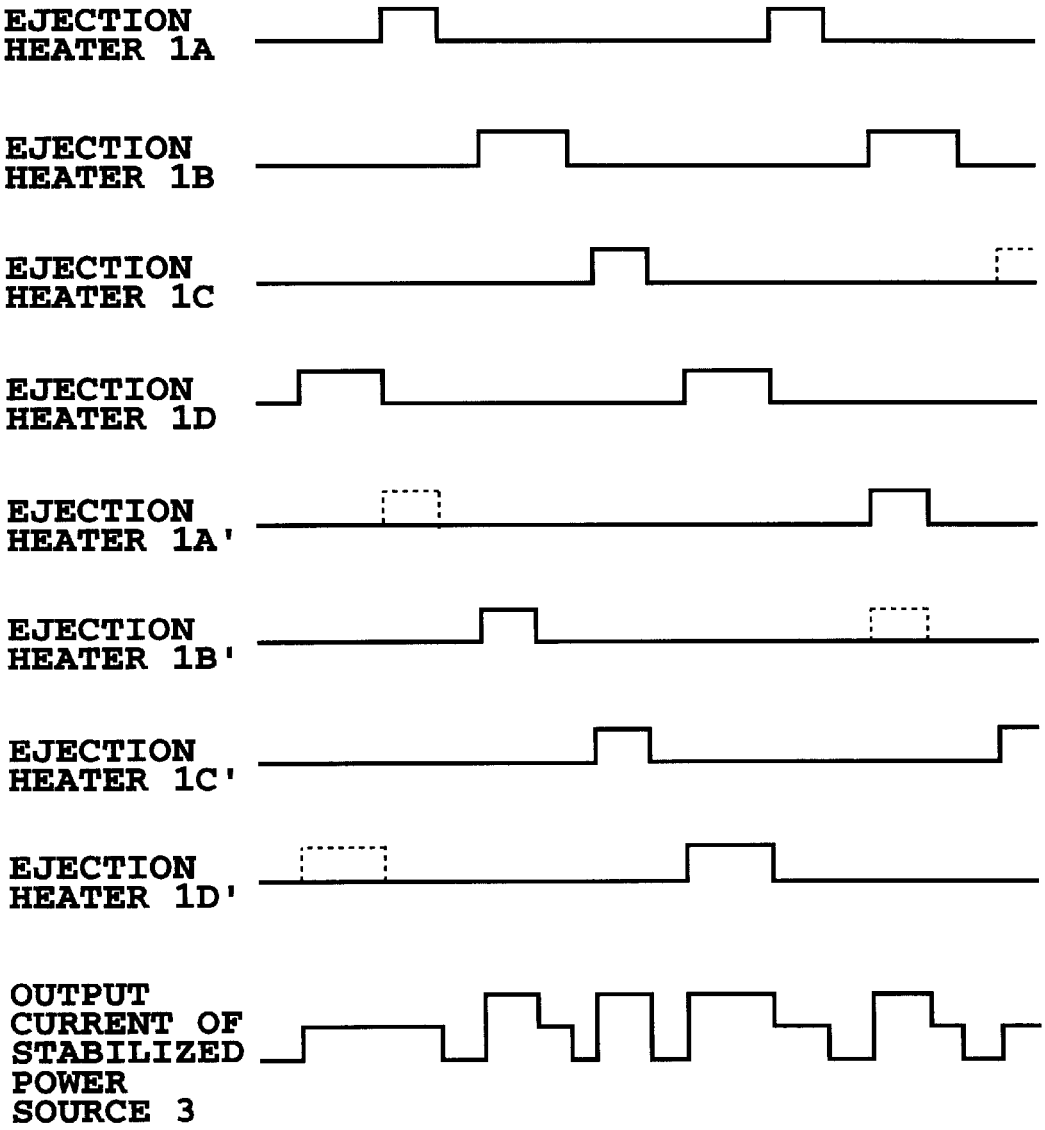
FIG. 3 is a chart showing waveforms of drive currents for ejection heaters, to be measured by the measuring circuit of FIG. 1.

Waveforms of the drive current flowing through respective of a plurality of ejection heaters 1 of the ink-jet head 20 are in a form of pulse as shown in FIG. 3. A waveform of the output current of the stabilized power source circuit 3 becomes a sum of those current. It should be noted that, in FIG. 3, current pulses are shown only for the ejection heaters 1A to 1D and 1A' to 1D' among 128 ejection heaters in the ink-jet head 20. Also, in FIG. 3, pulses shown by broken line represents that the corresponding heater is not driven. The reason of difference of the pulse widths per ejection heaters is to unify the ejection amount with compensating individual difference between ejection openings due to difference of heating characteristics of the ejection heaters and so on.

In the shown embodiment, driving of a plurality of ejection heaters 1 provided corresponding to respective ejection openings is performed in time division as shown by respective current pulses for the ejection heaters 1A to 1D and 1A' to 1D' in FIG. 3. By this, current capacities of a DC power source 8 and the stabilized power source circuit 3 can be made smaller. The 128 ejection openings are divided into 16 blocks and respective blocks are driven in time division basis. Therefore, the maximum number of the ejection heaters to be driven simultaneously becomes 8. Accordingly, by setting the resistance values of the resistors 4 and 6 so that 10 $\mu$A of current will flow through the FC timer 5 when only one ejection heater is driven, the maximum current value to flow becomes 80 $\mu$A which will not cause significant problem in operation of the FC timer.

Next, method of correction in the case where the ink temperature fluctuates, will be explained. In FIG. 1, a field effect transistor (hereinafter referred to as FET) 7 adjusts current flowing through the FC timer 5 based on a value detected by a temperature sensor 13 in the ink-jet head. More specifically, in general, when the head temperature is varied, the ink ejection amount is varied correspondingly. Therefore, amount of current actually flowing through the ejection heater 1 is not always corresponded to the instantaneous ejection amount. For instance, when a predetermined amount of current is flown through the ejection heater, greater amount of ink relative to the current flowing through the ejection heater should be ejected through the head having higher temperature. Therefore, in the shown embodiment, by means of the FET 7, power supply amount for the FC timer 5 is corrected based on an output of the temperature sensor 13 to make the power supply amount for the FC timer 5 consistent with the actual ejection amount.

Figure 4:
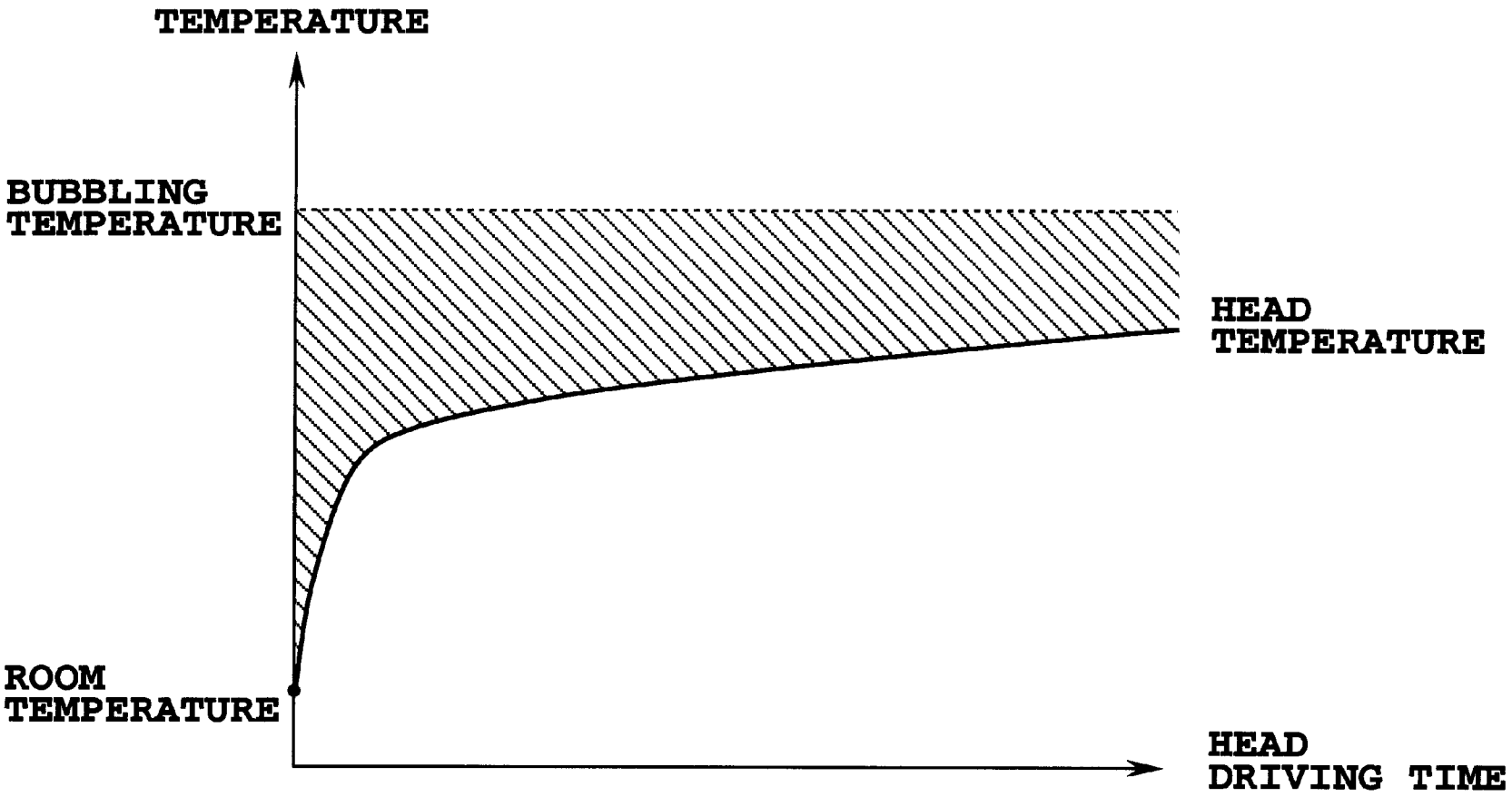
FIG. 4 is a chart for explaining fluctuation of ejection amount in the case that ejection is continuously performed.

On the other hand, FIG. 4 is an illustration for explaining a variation of the driving energy depending upon the head temperature. Namely, FIG. 4 illustrates variation of the head temperature when continuous ejection is performed in certain ejection opening, relative to elapsed time. As can be seen, at an initial state, the head temperature is substantially equal to a room temperature. The head temperature is elevated as time elapsed to gradually approach an equilibrium temperature. On the other hand, a temperature at which the bubble is generated in the ink on the surface of the ejection heater 1 is constant. Therefore, according to elevating of the head temperature, the driving energy required for bubbling (hatched portion in FIG. 4) is reduced.

As set forth above, according to the shown embodiment, in respective ejection heaters for ink ejection, in order to control amount of the supplied current in accordance with the head temperature, the current is not directly supplied as the current flowing through the FC timer 5, but, by employing the FET 7, the amount of the current supplied to the FC timer is corrected in view of the temperature of the ink-jet head. Detail will be explained hereinafter with reference to FIG. 1.

The temperature sensor 13 is provided at both end portions of the silicon substrate (not shown), on which the ejection heaters of the ink-jet head are formed. The output of the temperature sensor 13 is taken by a circuit constructed with an operational amplifier 12, amplified by an inverting amplifier circuit constructed with an operational amplifier, and then supplied as a gate voltage $V_{GS}$ of the FET 7 via a bias circuit constructed with a resistors 9 and 10. Since a diode sensor is employed as the temperature sensor 13, the gate voltage $V_{GS}$ of the FET 7 is expressed by:

$$V_{GS}=aV_F+b$$

and thus is varied linearly with respect to a forward voltage $V_F$ of the diode sensor 13. It should be noted that coefficients a and b in the foregoing equation are positive constants to be set as appropriate values by the inverting amplifier circuit formed with the operational amplifier 11. In this case, as shown in FIG. 4, the thermal energy required for bubbling to eject the ink is decreased linearly depending upon elevation of the head temperature. On the other hand, the amount of ejected ink is increased according to the elevation of the head temperature. Accordingly, the coefficients a and b in the foregoing equation are set to obtain $V_{GS}$ falling within a region where the relationship between the gate voltage $V_{GS}$ to be applied to the FET 7 and a current $I_D$ flowing through the FET 7 becomes substantially linear relationship. By this, an ON resistance of the FET 7 is varied depending upon the temperature detected by the diode sensor 13 to correct the value of the current $I_D$ flowing through the FC timer 5. Thus, the current corresponding to the instantaneous ejection amount, namely the greater amount of current as increasing of the ejection amount associating with elevation of the head temperature, may flow the FC timer 5.

As set forth above, by the current flowing through the FC timer 5 per occurrence of ejection, the position of the electrolyte 53 is varied to permit visual checking of the shifting magnitude and thus to permit precise detection of the amount of the consumed ink. Furthermore, affect of variation of the ejection amount due to fluctuation of the head temperature which possibly cause error in the position of the electrolyte otherwise, can be reduced. By preliminarily providing a marking at a position of the electrolyte 53 where the ink remaining amount is almost zero or little, on the glass tube of the FC timer 5, the ink remaining amount can be easily detected.

It should be noted that, by setting a detection means, such as a photosensor, for detecting the position of the electrolyte in place of the marking and by transmitting the signal indicative of the detected electrolyte position to a CPU of the printer, the timing of exchanging of the ink can be detected and alarmed automatically. As means for alarming, prior art such as turning on and off of a light, a sound or the like can be employed.

Figure 5:
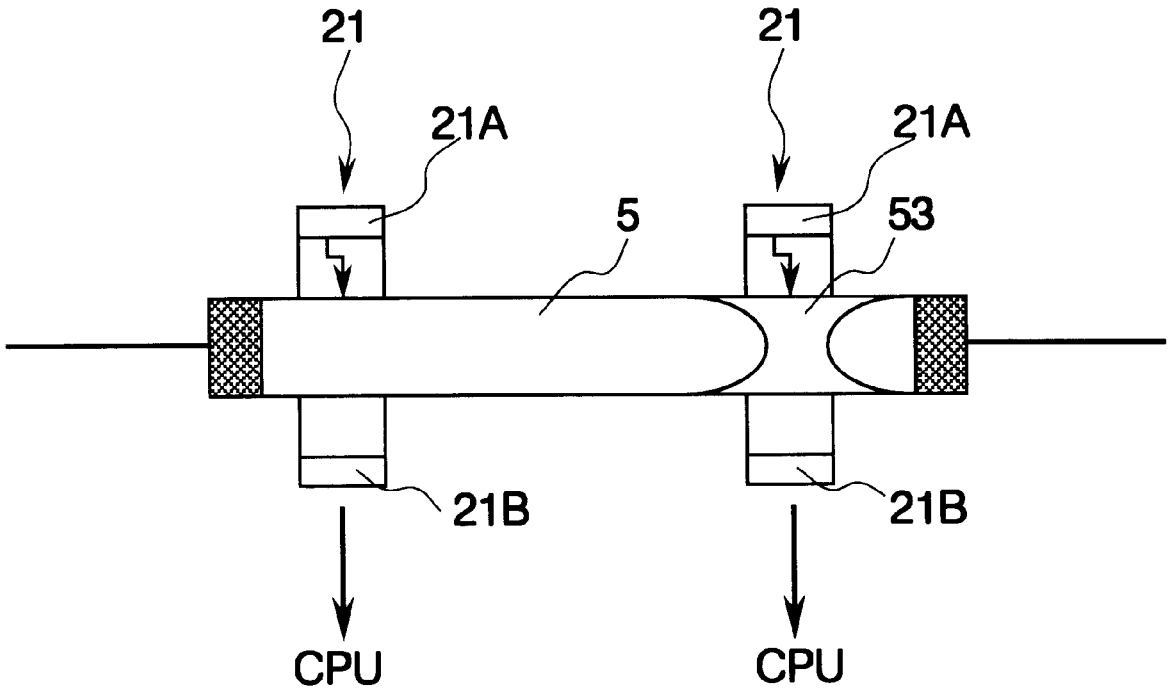
FIG. 5 is an illustration diagrammatically showing a construction for automatically reading a position of an electrolyte in the FC timer.

FIG. 5 shows a construction for realizing the foregoing automatic detection, in which a photosensor is mounted on the FC timer. As shown in FIG. 5, in the FC timer 5, photosensors 21 are respectively mounted at positions corresponding to the remaining amount of ink to be detected with respect to the position of the electrolyte 53 in the FC timer 5. By this, when the amount of ink does not reach the foregoing remaining amount, the mercury 52 may present at the position where the photosensor is mounted. Thus, a light emitted from a light emitting portion 21A is blocked and may not reach a photosensing portion 21B. Therefore, the predetermined remaining amount of the ink cannot be detected. However, when the ink is consumed to reach the foregoing predetermined remaining amount, the electrolyte 53 may be positioned at the position corresponding to the photosensor 21 to permit the light emitted from the light emitting portion 21A to pass through to reach the photosensing portion 21B. Thus, the remaining amount of the ink can be detected. The reason to provide the photosensors at both end portions of the FC timer 5 is for repeated use of the FC timer as will be explained later.

While the shown embodiment has been described in terms of the case where the FC timer is mounted on the head of the type, in which the ink-jet head and the ink tank are integrated, application of the present invention is, of course, not limited to the shown construction. For example, the same effect can be obtained even with the construction, in which the FC timer 5 is mounted on the ink tank side with necessary electrical connection in the construction where the ink tank and the ink-jet head are formed separately to permit exchanging only ink tank independent of the ink-jet head. Furthermore, it is possible to mount the FC timer on the main body of the printing apparatus.

As can be clear from FIG. 2, the FC timer 5 is designed to move the electrolyte in opposite direction when reverse connection is established. Therefore, the FC timer can be used repeatedly. For example, for the type where the ink tank can be exchanged, FC timer 5 mounted on the ink-jet head or the main body of the printing apparatus. Also, the FC timer 5 is constructed to permit reversal of connection of terminal and to reverse terminal connection of the FC timer at every occurrence of exchanging of the ink to repeatedly use the FC timer 5. With the construction set forth above, the similar effect to the foregoing embodiment can be expected.

Figure 6:
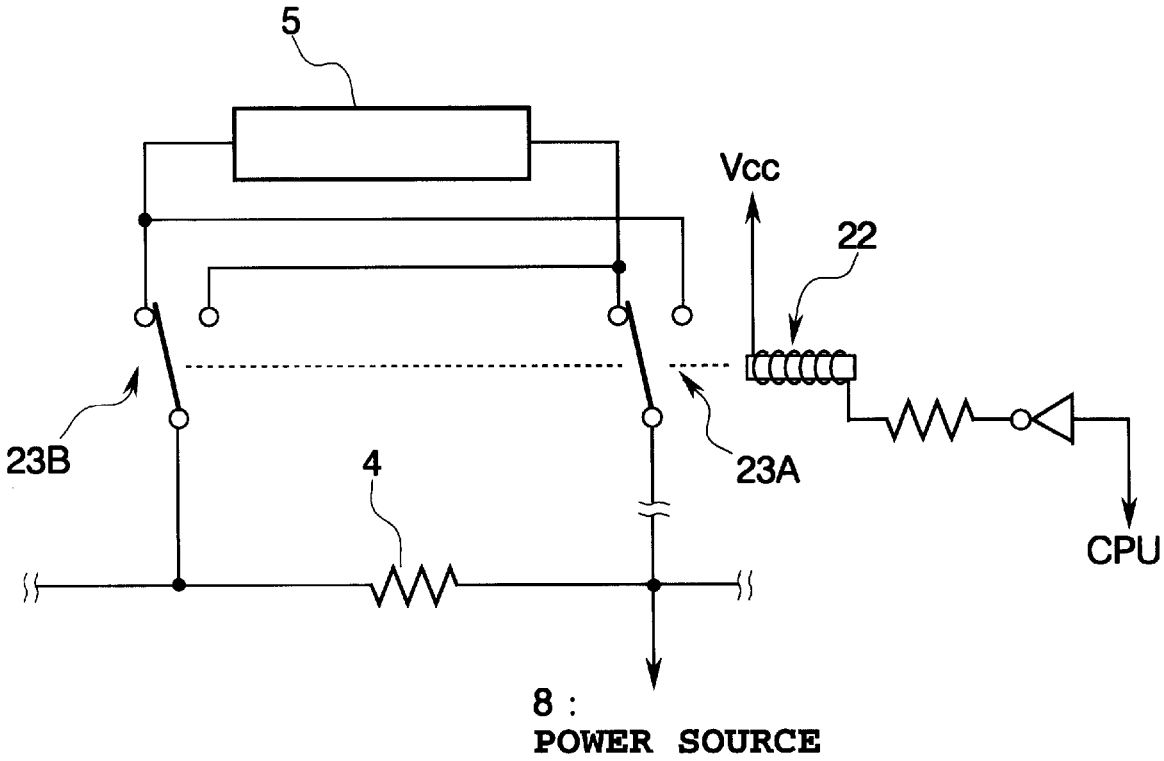
FIG. 6 is an illustration showing a construction for switching a direction of a current in the FC timer.

FIG. 6 is an illustration showing a construction for reversing connection of terminals of the FC timer 5. In FIG. 6, the FET 7 and the like and the circuit elements in the ink-jet head are neglected from illustration. As shown in FIG. 6, in response to a connection switching command from the CPU, a relay 22 is operated to switch connecting condition of selector switches 23A and 23B.

Figure 7:
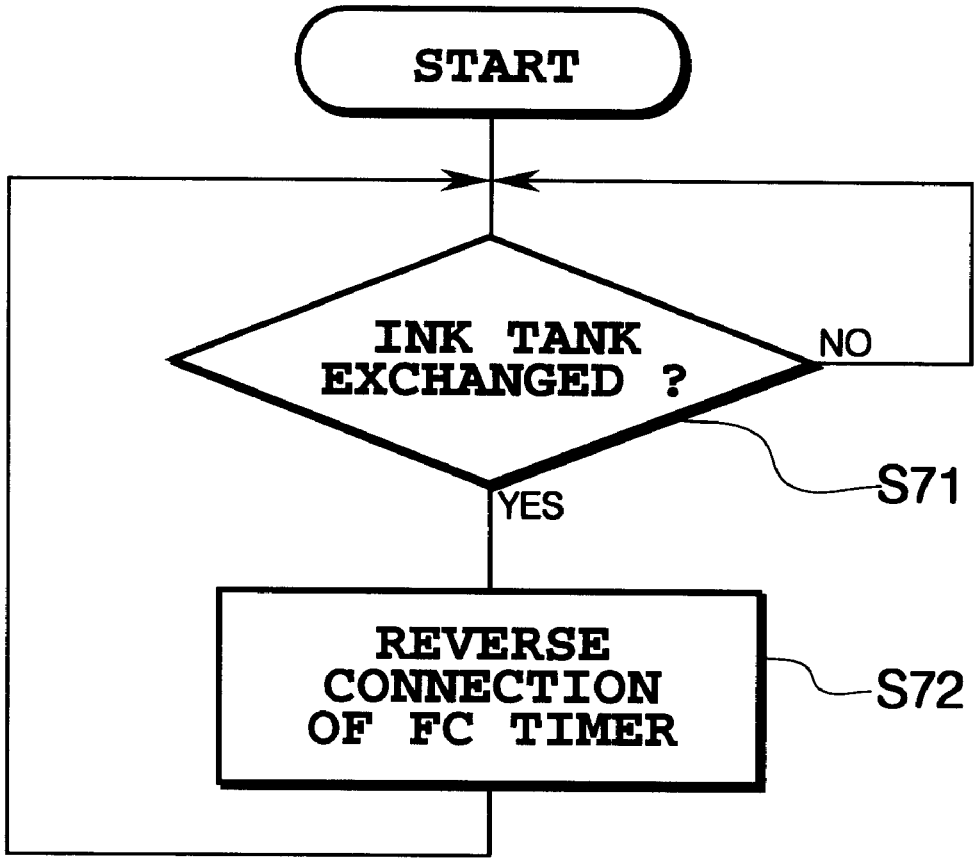
FIG. 7 is a flowchart showing procedure for switching the direction of the current.

FIG. 7 is a flowchart showing procedure of the foregoing switching process. When exchange of the ink tank is detected at step S71, switching of connection of the FC timer set forth above is performed at step S72.

Another mode of repeated use of the FC timer set forth above, it is possible to repeated use by returning the position of the electrolyte by flowing a current through the FC timer opposite to that detecting the ink remaining amount every time of exchanging of the ink tank.

On the other hand, the output of the temperature sensor 13 in the shown embodiment, is converted in hardware and applied as the gate voltage $V_{GS}$ of the FET 7. The output of the temperature sensor 13 is A/D converted. The CPU of the main body of the printing apparatus reads out the A/D converted output of the temperature sensor 13 and performs calculation for deriving the gate voltage $V_{GS}$ of the FET to further improve accuracy of detection of the ink remaining amount by applying the calculated gate voltage $V_{GS}$.

Figure 8:
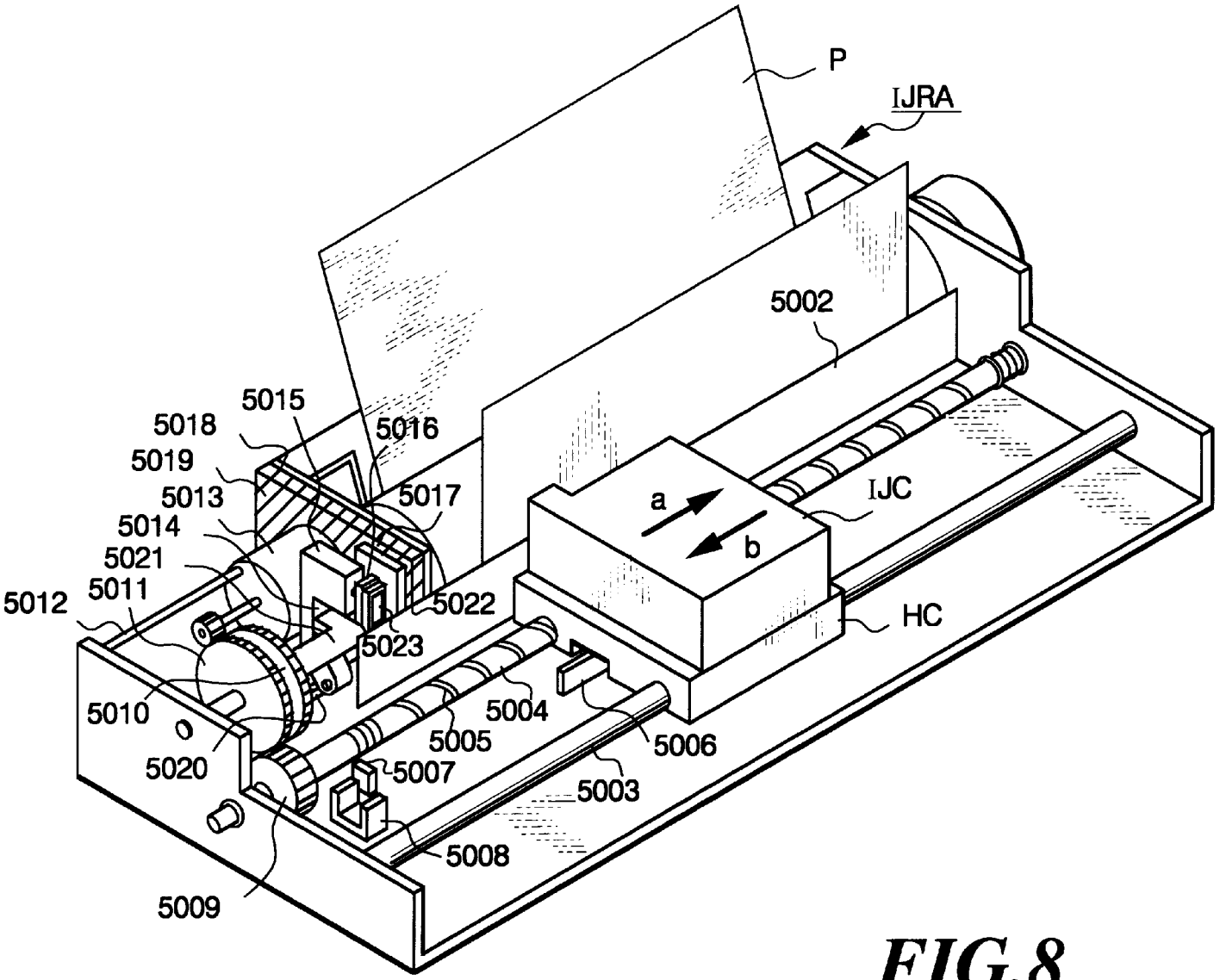
FIG. 8 is a perspective view showing one example of an ink-jet printing apparatus, to which the present invention is applicable.

FIG. 8 is a perspective view showing one example of an ink-jet printing apparatus, to which respective embodiments are applicable.

A carriage HC has a pin (not shown) for engaging with a spiral groove 5004 of a lead screw 5005 which is driven to rotate by a driving force of the driving motor 5013 via a transmission gears 5011 and 5009 according to forward and reverse rotation of the driving motor 5013. The carriage HC is driven reciprocally in the directions of arrows a and b according to rotation of the lead screw. To the carriage HC, a head cartridge IJC, in which the ink-jet head and the ink tank are integrated, is loaded. It should be noted that constructions for loading of the head cartridge and establishing electrical connection between the ink-jet head and the main body of the printing apparatus are neglected from illustration, the detail of which has been disclosed in a commonly owned Japanese Patent Application No. 1-241081 (1990). The reference numeral 5002 denotes a holding plate (paper holding plate) for a printing medium (hereinafter simply referred to as a paper), such as paper, OHP film or the like. The holding plate depresses the paper onto a platen 5000 over a carriage shifting direction. The reference numerals 5007 and 5008 denote photo couplers which serves as home position detecting means for performing switching of rotating direction of the motor 5013 by detecting presence of a lever 5006 of the carriage within the range where the home position detecting means is arranged. The reference numeral 5016 denotes a member supporting a capping member 5022 for capping the entire surface of the printing head, and the reference numeral 5016 denotes sucking means for sucking in the cap, for performing suction recovery of the ink-jet head via an opening 5023 within the cap. The reference numeral 5017 denotes a cleaning blade, 5019 denotes a member for enabling the blade to move in back and forth direction. The foregoing are supported on a main body support plate 5018. Needless to say, as the blade, the known cleaning blade not in the shown construction, can be applied to the shown embodiment. On the other hand, the reference numeral 5012 is a lever for initiating suction of the suction recovery. Associating with movement of a cam 5020 engaging with a carriage, the driving force from the driving motor is controlled by a known power transmission means, such as a clutch, for controlling movement of the carriage.

These capping, cleaning, suction recovery are adapted to perform necessary process in the action of the lead screw 5005 when the carriage HC is located at the position within a region of the home position. However, by designing to perform the desired operation at known timings, any of the foregoing embodiments may be applicable.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As set forth above, according to the shown embodiments of the present invention, the current to be supplied to the energy generating element is detected and the amount of current is integrated per ink ejection. Then, display depending upon the integrated amount is performed. Thus, total amount of the consumed ink can be known from the display.

As a result, it becomes possible to know the remaining amount of the ink with relatively simple construction at low cost.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for performing printing by ejecting ink toward a printing medium with an ink-jet head having an energy generating element for generating energy to eject the ink, comprising:

power supply means for supplying electric power to the energy generating element for ejecting the ink from the ink-jet head;

driving means for driving the energy generating element with the supplied electric power; and integrating means electrically connected to said power supply means to integrate an amount of current flowing in accordance with driving the energy generating element, the amount of current integrated by said integrating means being used to derive consumption of ink.

2. An ink-jet printing apparatus as claimed in claim 1, which further comprises head temperature detecting means for detecting temperature information related to a temperature of the ink to be ejected, and correcting means for correcting the current to be detected by said integrating means based on the temperature information detected by said head temperature detecting means.

3. An ink-jet printing apparatus as claimed in claim 2, wherein said correcting means increases amount of the current to be detected by said integrating means at higher ink temperature indicated by the temperature information detected by said head temperature detecting means.

4. An ink-jet printing apparatus as claimed in claim 1, which further comprises informing means for optically reading the display of said display portion and informing that a remaining amount of the ink has become less than or equal to a predetermined amount, based on the optical reading of the display.

5. An ink-jet printing apparatus as claimed in claim 1, wherein said integrating means includes a timer unit in which mercury and an electrolyte are enclosed in a tube having at least a transparent portion, and said timer unit detects current flowing through said timer unit, said electrolyte shifts depending upon amount of current, and the position of said electrolyte displays through said transparent portion.

6. An ink-jet printing apparatus as claimed in claim 5, which further comprises informing means having a photosensor detecting said electrolyte via said transparent portion of said timer unit, and informing that a remaining amount of the ink has become less than or equal to a predetermined amount, based on detection by said photosensor.

7. An ink-jet printing apparatus as claimed in claim 5, wherein said timer unit has a first shifting direction of the electrolyte and a second shifting direction opposite to said first shifting direction, the electrolyte being shiftable in the first or second direction based on current supplied.

8. An ink-jet printing apparatus as claimed in claim 7, which further comprises switching means for switching a direction of the current supplied to said timer unit for alternately using said first and second shifting directions of the electrolyte in said timer unit.

9. An ink-jet printing apparatus as claimed in claim 1, wherein said ink-jet head generates thermal energy by said energy generating element to perform ejection of the ink by generation of a bubble in the ink by thermal energy.

10. An ink-jet printing apparatus as claimed in claim 1, wherein said integrating means includes a display portion for performing display depending upon the integrated amount of electric current.

11. An ink-jet head comprising:

an energy generating element for generating energy to eject ink during supply of electric power;

driving means for driving the energy generating element with the supplied electric power; and integrating means electrically connected to a power supply means to integrate an amount of current flowing in accordance with driving the energy generating element, the amount of current integrated by said integrating means being used to derive consumption of ink.

12. An ink-jet head as claimed in claim 11, wherein said integrating means includes a timer unit in which mercury and an electrolyte are enclosed in a tube having at least a transparent portion, and said timer unit detects current flowing through said timer unit, said electrolyte shifts depending upon amount of current, and the position of said electrolyte displays through said transparent portion.

13. An ink-jet head as claimed in claim 11, wherein said integrating means includes a display portion for performing display depending upon the integrated amount of electric current.

14. An ink tank for storing ink to be supplied to an ink-jet head having an energy generating element for generating energy to eject the ink, comprising:

integrating means electrically connected to a power supply means to integrate an amount of current flowing in accordance with driving the energy generating element, the amount of current integrated by said integrating means being used to derive consumption of ink.

15. An ink tank as claimed in claim 14, wherein said integrating means includes a timer unit in which mercury and an electrolyte are enclosed in a tube having at least a transparent portion, and said timer unit detects current flowing through said timer unit, said electrolyte shifts depending upon amount of the current, and the position of said electrolyte displays through said transparent portion.

16. An ink tank as claimed in claim 14, wherein said integrating means includes a display portion for performing display depending upon the integrated amount of electric current.

17. An ink-jet unit integrally having an ink-jet head having an energy generating element for generating energy to eject ink and an ink tank storing ink to be supplied to said ink-jet head, comprising:

integrating means electrically connected to a power supply means to integrate an amount of current flowing in accordance with driving the energy generating element, the amount of current integrated by said integrating means being used to derive consumption of ink.

18. An ink-jet unit as claimed in claim 17, wherein said integrating means includes a timer unit in which mercury and an electrolyte are enclosed in a tube having at least a transparent portion, and said timer unit detects current flowing through said timer unit, said electrolyte shifts depending upon amount of the detected current, and the position of said electrolyte displays through said transparent portion.

19. An ink-jet unit as claimed in claim 17, wherein said integrating means includes a display portion for performing display depending upon the integrated amount of electric current.

* * * * *

UNITED STATES PATENT AND TRADEMARK OFFICE

CERTIFICATE OF CORRECTION

PATENT NO. : 6,109,714
DATED : August 29, 2000
INVENTOR(S) : Tsuruoka

It is certified that error appears in the above-identified patent and that said Letters Patent is hereby corrected as shown below:

Title page,
Item [56], References Cited, U.S. PATENT DOCUMENTS, insert

| | | | | |
|---|---|---|---|---|
| -- | 4,313,124 | 1/1982 | Hara | 346/140R |
| | 4,345,262 | 8/1982 | Shirato et al. | 346/140R |
| | 4,459,600 | 7/1984 | Sato et al. | 346/140R |
| | 4,463,359 | 7/1984 | Ayata et al. | 346/1.1 |
| | 4,558,333 | 12/1985 | Sugitani et al. | 346/140R |
| | 4,608,577 | 8/1986 | Hori | 346/140R |
| | 4,723,129 | 2/1988 | Endo et al. | 346/1.1 |
| | 4,740,796 | 4/1988 | Endo et al. | 346/1.1 -- |

Item [56], References Cited, FOREIGN PATENT DOCUMENTS, insert

| | | | |
|---|---|---|---|
| -- | 54-56847 | 5/1979 | Japan |
| | 59-123670 | 7/1984 | Japan |
| | 59-138461 | 8/1984 | Japan |
| | 60-71260 | 4/1985 | Japan -- |

Column 2,
Line 66, “be” should read -- the --.

Column 3,
Line 34, “other” should read -- another --;
Line 36, “obscure” should read -- obscurity of --; and
Line 59, “feed” should read -- fed --.

Column 4,
Line 40, “current.” should read -- currents --; and
Line 62, “cause” should read -- cause a --.

Column 5,
Line 36, “Detail” should read -- Details --; and
Line 45, “a” should be deleted.

Column 6,
Line 4, “flow” should read -- flow through --;
Line 10, “which” should read -- which can --; and
Line 31, “may” should read -- may be --.

UNITED STATES PATENT AND TRADEMARK OFFICE

CERTIFICATE OF CORRECTION

PATENT NO. : 6,109,714
DATED : August 29, 2000
INVENTOR(S) : Tsuruoka

It is certified that error appears in the above-identified patent and that said Letters Patent is hereby corrected as shown below:

Column 7,
Line 12, “repeated” should read -- repeat --.

Column 8,
Line 2, “process” should read -- processes --.
Line 48, “Laying” should read -- Laid --.
Line 58, “be also” should read -- also be --; and
Line 61, “consists” should read -- consist --.

Column 9,
Line 18, “be also” should read -- also be --; and
Line 51, “Laying” should read -- Laid --.

Signed and Sealed this

Thirteenth Day of August, 2002

*Attest:*

*Attesting Officer*

JAMES E. ROGAN
*Director of the United States Patent and Trademark Office*